US011852032B2

(12) United States Patent
Kuwamura et al.

(10) Patent No.: US 11,852,032 B2
(45) Date of Patent: Dec. 26, 2023

(54) TURBINE

(71) Applicant: MITSUBISHI HEAVY INDUSTRIES, LTD., Tokyo (JP)

(72) Inventors: Yoshihiro Kuwamura, Tokyo (JP); Shigeo Ookura, Tokyo (JP); Shunsuke Mizumi, Tokyo (JP); Chongfei Duan, Tokyo (JP); Hideaki Sugishita, Tokyo (JP); Kazuyuki Matsumoto, Tokyo (JP); Naoto Omura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/796,377

(22) PCT Filed: Jan. 26, 2021

(86) PCT No.: PCT/JP2021/002635
§ 371 (c)(1),
(2) Date: Jul. 29, 2022

(87) PCT Pub. No.: WO2021/153556
PCT Pub. Date: Aug. 5, 2021

(65) Prior Publication Data

US 2023/0111300 A1 Apr. 13, 2023

(30) Foreign Application Priority Data

Jan. 31, 2020 (JP) ..... 2020-015615

(51) Int. Cl.
*F01D 25/30* (2006.01)
*F01D 25/24* (2006.01)

(52) U.S. Cl.
CPC ..... *F01D 25/30* (2013.01); *F01D 25/24* (2013.01); *F05D 2220/31* (2013.01)

(58) Field of Classification Search
CPC ..... F01D 25/30; F01D 25/24; F02C 7/045; F02C 7/141; B64C 11/001;
(Continued)

(56) References Cited

U.S. PATENT DOCUMENTS 3,447,741 A * 6/1969 Jean ..... B64C 11/001 415/207
3,735,593 A * 5/1973 Howell ..... F04D 29/324 415/115
(Continued)

FOREIGN PATENT DOCUMENTS

DE 10255389 A1 6/2004
JP S59-065907 U 5/1984
(Continued)

OTHER PUBLICATIONS

International Search Report in corresponding International Application No. PCT/JP2021/002635, dated Mar. 23, 2021 (6 pages).
(Continued)

*Primary Examiner* — Craig Kim
(74) *Attorney, Agent, or Firm* — Osha Bergman Watanabe & Burton LLP

(57) ABSTRACT

A turbine includes a rotor including a rotation shaft that rotates around an axis and a blade row formed on an outer surface of the rotation shaft; a casing, which covers the rotor, has a casing inner surface being expanded radially outward approaching a downstream side of the casing in a direction of the axis; and an inner member body formed to line the casing inner surface of the casing such that an extraction port is formed between an upstream side end of the inner member body and the casing inner surface. A discharge port is formed between a downstream side end of the inner peripheral member body and the casing inner peripheral surface. The extraction port and the discharge port are formed in an annular shape centered on the axis. A flow path cross-
(Continued)

sectional area of the discharge port is smaller than that of the extraction port.

9 Claims, 5 Drawing Sheets

(58) Field of Classification Search
CPC ..... F01N 2270/02; F05D 2220/32; F05D 2220/31; F05D 2240/304; F05D 2250/323
See application file for complete search history.

(56) References Cited

U.S. PATENT DOCUMENTS

| | | | | |
|---|---|---|---|---|
| 5,588,799 | A | 12/1996 | Kreitmeier | |
| 6,102,655 | A * | 8/2000 | Kreitmeier | F01D 11/08 415/173.5 |
| 9,249,687 | B2 * | 2/2016 | Nanda | F01D 25/30 |
| 10,883,387 | B2 * | 1/2021 | Zhang | F02C 7/141 |
| 11,452,424 | B2 * | 9/2022 | Sato | A47L 5/362 |
| 2002/0127100 | A1 | 9/2002 | Kreitmeier | |
| 2007/0089422 | A1 | 4/2007 | Widenhoefer et al. | |
| 2010/0226767 | A1 * | 9/2010 | Becker | F15D 1/0025 415/207 |
| 2010/0232966 | A1 * | 9/2010 | Ono | F01D 5/225 416/179 |
| 2010/0251716 | A1 | 10/2010 | Boss et al. | |
| 2015/0176435 | A1 | 6/2015 | Nagao et al. | |
| 2016/0369654 | A1 | 12/2016 | Fukushima et al. | |
| 2017/0234135 | A1 | 8/2017 | Takamura et al. | |
| 2019/0277139 | A1 | 9/2019 | Matsumoto et al. | |
| 2023/0111300 | A1 * | 4/2023 | Kuwamura | F01D 25/24 60/772 |

FOREIGN PATENT DOCUMENTS

| | | | |
|---|---|---|---|
| JP | H08042306 | A | 2/1996 |
| JP | H08-260905 | A | 10/1996 |
| JP | 2002-081301 | A | 3/2002 |
| JP | 2007-120499 | A | 5/2007 |
| JP | 2009-036118 | A | 2/2009 |
| JP | 2009-103099 | A | 5/2009 |
| JP | 2010-242759 | A | 10/2010 |
| JP | 2011-069308 | A | 4/2011 |
| JP | 2011-099380 | A | 5/2011 |
| JP | 2011-169172 | A | 9/2011 |
| JP | 2011-220125 | A | 11/2011 |
| JP | 2012-149614 | A | 8/2012 |
| JP | 2013148059 | A | 8/2013 |
| JP | 2016-050494 | A | 4/2016 |
| JP | 2016-217285 | A | 12/2016 |
| JP | 2017-008756 | A | 1/2017 |
| JP | 2019157680 | A | 9/2019 |
| RU | 2256801 | C2 | 7/2005 |
| WO | 2013/027239 | A1 | 2/2013 |
| WO | 2014-010287 | A1 | 1/2014 |

OTHER PUBLICATIONS

Written Opinion in corresponding International Application No. PCT/JP2021/002635, dated Mar. 23, 2021 (10 pages).

* cited by examiner

TURBINE

TECHNICAL FIELD

The present disclosure relates to a turbine.

Priority is claimed on Japanese Patent Application No. 2020-015615, filed Jan. 31, 2020, the content of which is incorporated herein by reference.

BACKGROUND ART

A turbine including a steam turbine or a gas turbine includes a rotation shaft which rotates around an axis, a rotor which includes a blade row provided on an outer peripheral surface of the rotation shaft, a tubular casing which covers an outer circumference of the rotor, and a vane row which is provided on an inner peripheral surface of the casing. For example, in the steam turbine, when high-pressure steam is supplied into the casing, a rotation force is given to the rotor through blades. In the gas turbine, a rotation force is given to the rotor by a high-temperature and high-pressure combustion gas supplied from a combustor.

As described in Patent Document 1, since a pressure of a fluid decreases toward the downstream side in the casing, it is general that the inner peripheral surface of the casing is expanded in diameter radially outward toward the downstream side.

CITATION LIST

Patent Document(s)

Patent Literature 1: Japanese Unexamined Patent Application, First Publication No. 2011-69308

SUMMARY OF INVENTION

Technical Problem

Here, when the inner peripheral surface of the casing is excessively expanded radially toward the downstream side, the flow of the fluid cannot keep up with the expansion of the inner peripheral surface and the separation occurs. Since such a separation leads to the loss, there is concern that the performance of the turbine is affected. Although it is preferable to expand the casing inner peripheral surface in the radial direction when improving the output of the turbine, the radial expansion of the inner peripheral surface of the conventional casing has been restricted since it is necessary to avoid a deterioration in performance due to the separation.

An object of the present disclosure is to provide a turbine with further improved performance by suppressing a separation due to a large radial expansion of an inner peripheral surface toward a downstream side and reducing loss due to the separation.

Solution to Problem

In order to solve the above-described problems, a turbine according to the present disclosure includes: a rotor including a rotation shaft which is allowed to rotate around an axis and a blade row formed on an outer peripheral surface of the rotation shaft; a casing covering an outer circumference of the rotor and which has a casing inner peripheral surface being expanded radially outward as it approaches a downstream side of the casing in a direction of the axis; and an inner peripheral member body which is formed to line the casing inner peripheral surface of the casing such that an extraction port is formed between an upstream side end of the inner peripheral member body and the casing inner peripheral surface, and a discharge port is formed between a downstream side end of the inner peripheral member body and the casing inner peripheral surface, wherein the extraction port and the discharge port are formed in an annular shape centered on the axis, and wherein a flow path cross-sectional area of the discharge port is smaller than that of the extraction port.

Advantageous Effects of Invention

According to the present disclosure, it is possible to provide a turbine with further improved performance by reducing efficiency loss.

DESCRIPTION OF EMBODIMENTS

First Embodiment (Configuration of Steam Turbine)

Figure 1:
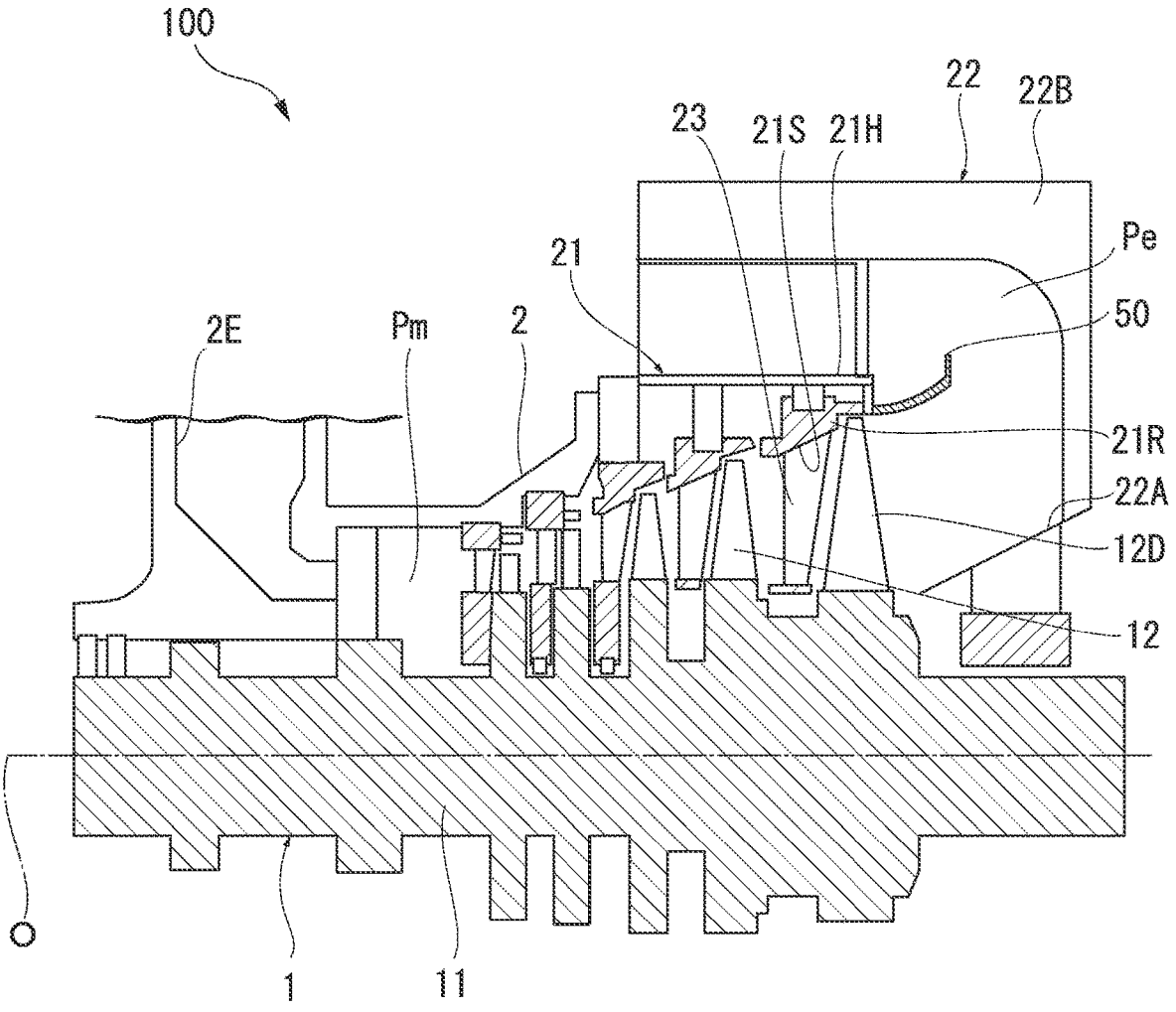
FIG. 1 is a cross-sectional view showing a configuration of a steam turbine according to a first embodiment of the present disclosure.

Hereinafter, a steam turbine 100 will be described as an example of a turbine according to a first embodiment of the present disclosure with reference to FIG. 1 and FIG. 2. The steam turbine 100 includes a rotor 1, a casing 2, and an inner peripheral member 40 (see FIG. 2).

The rotor 1 includes a columnar rotation shaft 11 extending in an axis O and a plurality of blade rows 12 which are provided on the outer peripheral surface of the rotation shaft 11. The rotation shaft 11 is allowed to rotate around the axis O. Each of the blade rows 12 includes a plurality of blades arranged in a circumferential direction with respect to the axis O on the outer peripheral surface of the rotation shaft 11. The plurality of blade rows 12 are arranged at intervals on the rotation shaft 11 in the direction of the axis O.

The casing 2 includes an inner casing 21 and an exhaust casing 22. The inner casing 21 covers an outer circumference of the rotor 1 to form a main flow path Pm between the outer peripheral surface of the rotor 1 and the inner casing. The inner casing 21 includes a tubular inner casing body 21H which is centered on the axis O, a plurality of vane holding rings 21R which are fixed to the inner peripheral side of the inner casing body 21H, and vane rows 23 which are provided on the further inner peripheral sides of the vane holding rings 21R.

The vane holding ring 21R is provided on one side of each of the plurality of blade rows 12 in the direction of the axis O, that is, the upstream side in the fluid flow direction. Each vane holding ring 21R is formed in an annular shape centered on the axis O. An inner peripheral surface 21S (casing inner peripheral surface) of the vane holding ring 21R is extended so as to be expanded radially outward as it goes from one side to the other side of the direction of the axis O. The vane row 23 includes a plurality of vanes which extend radially inward from the inner peripheral surface 21S of the vane holding ring 21R. That is, the vane rows 23 and the blade rows 12 are alternately arranged in the main flow path Pm from one side to the other side of the direction of the axis O.

An end portion of the inner casing 21 on one side of the direction of the axis O is provided with a supply pipe 2E into which high-temperature and high-pressure steam derived from an external steam supply source flows. An on-off valve and a regulating valve (not shown) are attached on the extension line of the supply pipe 2E. The steam derived from the supply pipe 2E into the inner casing 21 alternately collides with the vane row 23 and the blade row 12 in the middle of flowing through the main flow path Pm. In the following description, the side on which the steam flows in the direction of the axis O may be referred to as the upstream side and the side on which the steam flows away may be referred to as the downstream side. Further, the blade row 12 disposed on the most downstream side of the plurality of blade rows 12 may be referred to as a final stage blade row 12D. Additionally, a shroud 12S is provided at the tips of all blade rows 12 including the final stage blade row 12D.

The exhaust casing 22 is connected to the downstream side of the inner casing 21. The exhaust casing 22 forms a flow path (exhaust flow path Pe) for deriving the steam discharged from the main flow path Pm to an external device (a water condensing device or the like). Specifically, the exhaust casing 22 includes a bearing cone 22A, an outer casing 22B which covers an outer circumference of the bearing cone 22A, and a flow guide 50. The bearing cone 22A has a conical shape extending so as to be expanded radially outward as it approaches the downstream side of the bearing cone 22A from the upstream side. The outer casing 22B has a partially bottomed tubular shape that covers the bearing cone 22A from the downstream side and the radial outside. The steam having flowed into the exhaust flow path Pe flows toward the downstream side along the bearing cone 22A, turns radially outward, and further flows toward the upstream side along the inner surface of the outer casing 22B.

(Configuration of Flow Guide)

The flow guide 50 is provided to smoothly guide the above-described steam flow in the exhaust flow path Pe. The flow guide 50 has a tubular shape extending further toward the downstream side from the downstream edge of the inner casing body 21H. More specifically, the flow guide 50 has a funnel shape of which diameter is gradually expanded toward the downstream side. Additionally, an inner peripheral surface 505 of the flow guide 50 continues to the inner peripheral surface of the vane holding ring 21R and forms part of the inner peripheral surface 21S (casing inner peripheral surface).

Here, as described above, the diameter of a region from the inner peripheral surface 21S (casing inner peripheral surface) of the vane holding ring 21R corresponding to the final stage blade row 12D to the inner peripheral surface 505 of the flow guide 50 is sharply expanded. If the diameter expansion is formed more sharply, the flow of the fluid cannot follow the inner peripheral surface 21S, and the flow will be separated from the inner peripheral surface 50S. If such the separation happens, efficiency loss occurs and the performance of the steam turbine 100 is affected.

Figure 2:
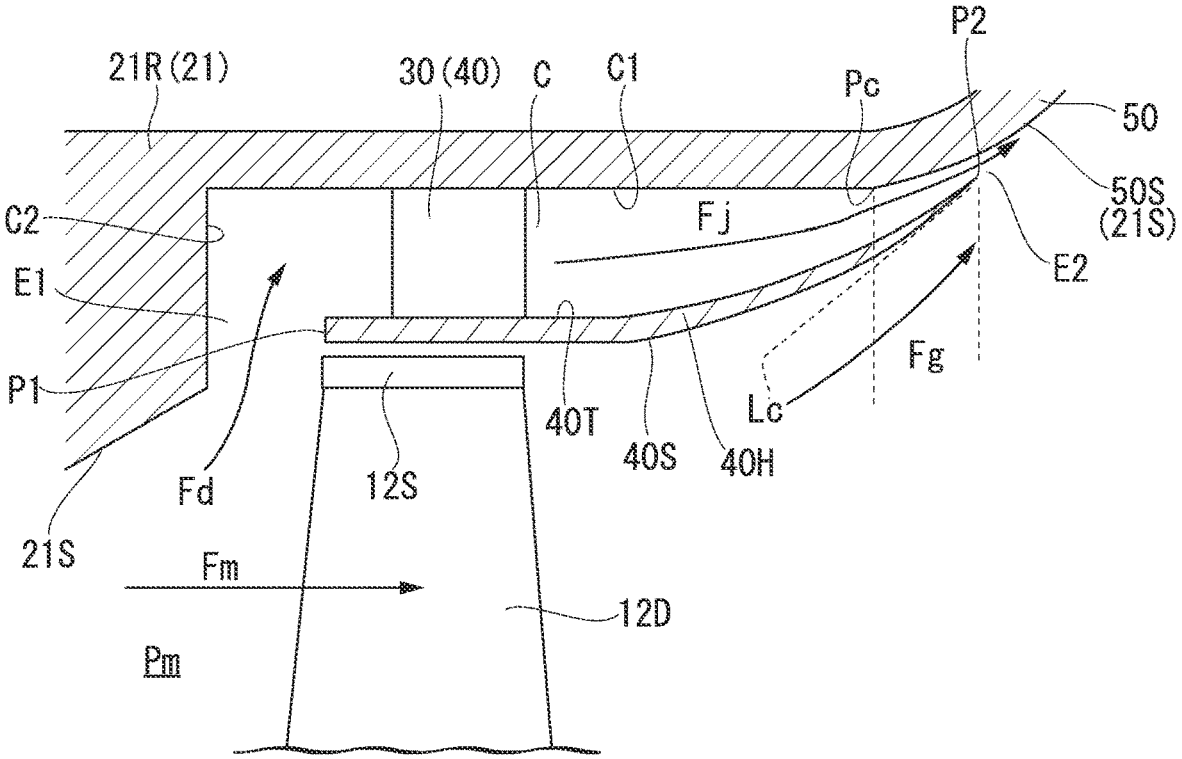
FIG. 2 is a main enlarged cross-sectional view of the steam turbine according to the first embodiment of the present disclosure.

In this embodiment, as shown in FIG. 2, a cavity C is formed on the inner peripheral surface 21S of the vane holding ring 21R corresponding to the final stage blade row 12D and the inner peripheral member 40 lining the inner peripheral surface 21S is placed inside the cavity C.

(Configuration of Inner Peripheral Member)

The cavity C is a recess which is formed in a portion corresponding to the final stage blade row 12D in the inner peripheral surface 21S. The cavity C is recessed radially outward from the inner peripheral surface 21S and is formed in an annular shape centered on the axis O. The radial outer surface in the cavity C is a cavity inner peripheral surface C1 and the upstream surface is a cavity upstream surface C2. The cavity inner peripheral surface C1 has a cylindrical surface shape centered on the axis O as an example. Additionally, the cavity inner peripheral surface C1 can have a shape in which the radial dimension changes in the direction of the axis O. The cavity upstream surface C2 spreads radially with respect to the axis O.

The inner peripheral member 40 includes support portions 30 and an inner peripheral member body 40H. Each of the support portions 30 is extended radially inward from the cavity inner peripheral surface C1. The support portions 30 are arranged at intervals in the circumferential direction on the cavity inner peripheral surface C1. The radial inner end portion of the support portion 30 is connected to an outer peripheral surface (a flow path forming surface 40T to be described later) of the inner peripheral member body 40H.

The inner peripheral member body 40H has a tubular shape centered on the axis O. The outer peripheral surface of the inner peripheral member body 40H is the flow path forming surface 40T. The flow path forming surface 40T faces the cavity inner peripheral surface C1 with a radial gap therebetween. The flow path forming surface is gradually curved radially outward toward the downstream side. The inner peripheral surface of the inner peripheral member body 40H is a guide surface 40S. The guide surface 40S faces the above-described main flow path Pm. Similarly to the flow path forming surface 40T, the guide surface 40S is gradually curved radially outward toward the downstream side.

An upstream edge P1 of the inner peripheral member body 40H is headed to the cavity upstream surface C2 with a gap in the direction of the axis O. This gap is an extraction port E1 which communicates the inside of the cavity C with the main flow path Pm. That is, a part of the steam in the main flow path Pm flows into the cavity C through the extraction port E1. On the other hand, a downstream edge P2 of the inner peripheral member body 40H is close to an inner peripheral surface 50S (21S) of the flow guide 50 connected to the downstream side of the cavity C with a gap therebetween. This gap is a discharge port E2. The steam having flowed into the cavity C is blown out from the discharge port E2 toward the downstream side as a jet air flow Fj.

Here, the flow path cross-sectional area of the discharge port E2 is made smaller than the flow path cross-sectional area of the extraction port E1. That is, a separation distance between the downstream edge P2 of the inner peripheral member body 40H and the inner peripheral surface of the flow guide 50 is made smaller than a separation distance between the upstream edge P1 and the cavity upstream surface C2. Further, the downstream edge P2 of the inner peripheral member body 40H is located on the further downstream side of the beginning point Pc of the flow guide 50 (that is, the upstream edge of the flow guide 50) in the direction of the axis O. Further, in a cross-sectional view of the turbine cut in the direction of the axis O, a tangent line Lc through the edge P2 of the discharge port E2 in the inner peripheral member body 40H is inclined so as to be gradually far away from the axis O toward the downstream side. Accordingly, the above-described jet air flow Fj is blown out to spread radially outward toward the downstream side.

(Operation and Effect)

Next, the operation of the steam turbine 100 according to this embodiment will be described. While operating the steam turbine 100, a high-temperature and high-pressure steam generated by an external steam supply source (boiler or the like) is guided to the inside (main flow path Pm) of the casing 2 through the supply pipe 2E. The steam collides with the blade row 12 while being guided by the vane row 23 in the middle of flowing through the main flow path Pm toward the downstream side. Accordingly, the rotor 1 rotates around the axis O. The rotational energy of the rotor 1 is taken out from the shaft end is used to drive an external device such as a generator. The steam having passed through the main flow path Pm is sent to another device (for example, a water condensing device) through the above-described exhaust flow path Pe.

Here, the inner peripheral surface of the flow guide 50 posterior to the downstream end of the inner peripheral surface 21S (casing inner peripheral surface) of the vane holding ring 21R corresponding to the final stage blade row 12D is sharply expanded in diameter for recovering the pressure of the fluid. If the diameter expansion is formed more sharply, the flow of the fluid may not be able to follow the inner peripheral surface, and the flow may be separated. Such separation leads to efficiency loss and may affect the performance of the steam turbine 100.

However, as shown in FIG. 2, in this embodiment, a part of the steam flowing through the casing 2 branches from the main flow Fm and flows into the cavity C as a branch flow Fd through the extraction port E1. In the flow path cross-sectional area of the discharge port E2, the steam having flowed into the cavity C is blown out from the discharge port E2 toward the downstream side as the jet air flow Fj. Accordingly, the flow (expanded flow Fg) following the inner peripheral surface (guide surface 40S) of the inner peripheral member body 40H is drawn to the jet air flow Fj blown out from the discharge port E2 by the Coanda effect. Thus, it is possible to suppress the separation of the steam from the inner peripheral surface 21S on the downstream side of the inner peripheral member body 40H. Further, in the above-described configuration, since the extraction port E1 and the discharge port E2 are formed in an annular shape centered on the axis O, it is possible to suppress the occurrence of the separation over the entire circumference in the casing 2. Further, according to the above-described configuration, the flow path cross-sectional area of the discharge port E2 is set to be smaller than the flow path cross-sectional area of the extraction port E1. Accordingly, the pressure in the cavity is substantially the same as the pressure of the main flow on the upstream side of the final stage blade row 12D and the differential pressure with the pressure of the expanded flow Fg in the vicinity of the discharge port E2 having passed through the final stage blade row increases. Further, since the outer peripheral surface of the inner peripheral member body 40H is gradually curved radially outward toward the downstream side to the edge P2 and the gap with the cavity inner peripheral surface C1 is narrowed toward the downstream side, the flow velocity of the steam flowing through the cavity C increases toward the discharge port E2. As a result, the flow velocity of the steam (jet air flow Fj) blown out from the discharge port E2 can be made higher than the flow velocity of the steam flowing outside the cavity C. Thus, it is possible to further reduce the possibility that a separation of a flow occurs on the downstream side of the cavity C.

Further, according to the above-described configuration, since the tangent line Lc through the edge P2 of the discharge port E2 in the inner peripheral member body is inclined so as to be far away from the axis O toward the downstream side, the flow blown out from the discharge port E2 can follow the inner peripheral surface 21S on the downstream side of the inner peripheral member body 40H. That is, the jet air flow Fj can flow to the downstream side while spreading radially outward. Accordingly, the development of the Coanda effect is promoted, and the flow can be further drawn toward the inner peripheral surface 21S. That is, it is possible to further suppress the separation of the flow.

According to the above-described configuration, the edge P2 on the side of the discharge port E2 in the inner peripheral member body 40H is located on the downstream side of the beginning point Pc of the flow guide 50. That is, a wider range in the inner peripheral member body 40H is lined by the flow guide 50. Here, the separation of the flow is likely to occur in the downstream region in relation to the beginning point Pc of the flow guide 50. According to the above-described configuration, it is possible to improve the effect (Coanda effect) in which the flow blown out from the discharge port E2 further follows the inner peripheral surface 21S. As a result, it is possible to further reduce the possibility of the separation of the flow. Further, since the occurrence of the separation is avoided in this way, it is possible to adopt the flow guide 50 having a shape with larger pressure recovery.

Further, according to the above-described configuration, it is possible to stably support the inner peripheral member body 40H on the inner peripheral side of the cavity C by the support portions 30 arranged in the circumferential direction on the cavity inner peripheral surface C1.

The first embodiment of the present disclosure has been described above. Further, various changes and modifications can be made to the above configuration without departing from the gist of the present disclosure.

First Modified Example

Figure 3:
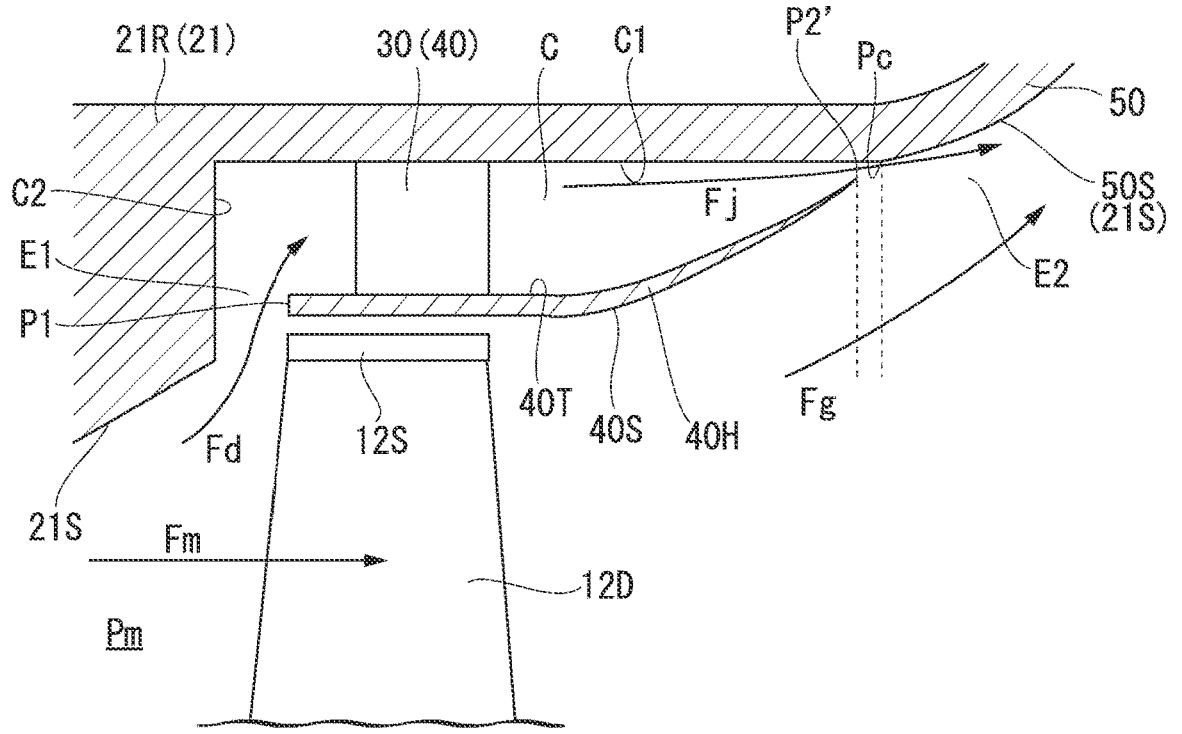
FIG. 3 is a main enlarged cross-sectional view showing a modified example of the steam turbine according to the first embodiment of the present disclosure.

For example, as shown in FIG. 3, a configuration in which a downstream edge P2' of the inner peripheral member body 40H is located on the upstream side of a beginning point Pc' of the flow guide 50 can be adopted. With such a configuration, since the separation is less likely to occur even when the expansion rage of the inner diameter is increased immediately from the beginning point Pc' of the flow guide 50, the exhaust chamber can be miniaturized in both the direction of the axis O and the radial direction and the entire steam turbine 100 can be miniaturized.

Second Modified Example

Figure 4:
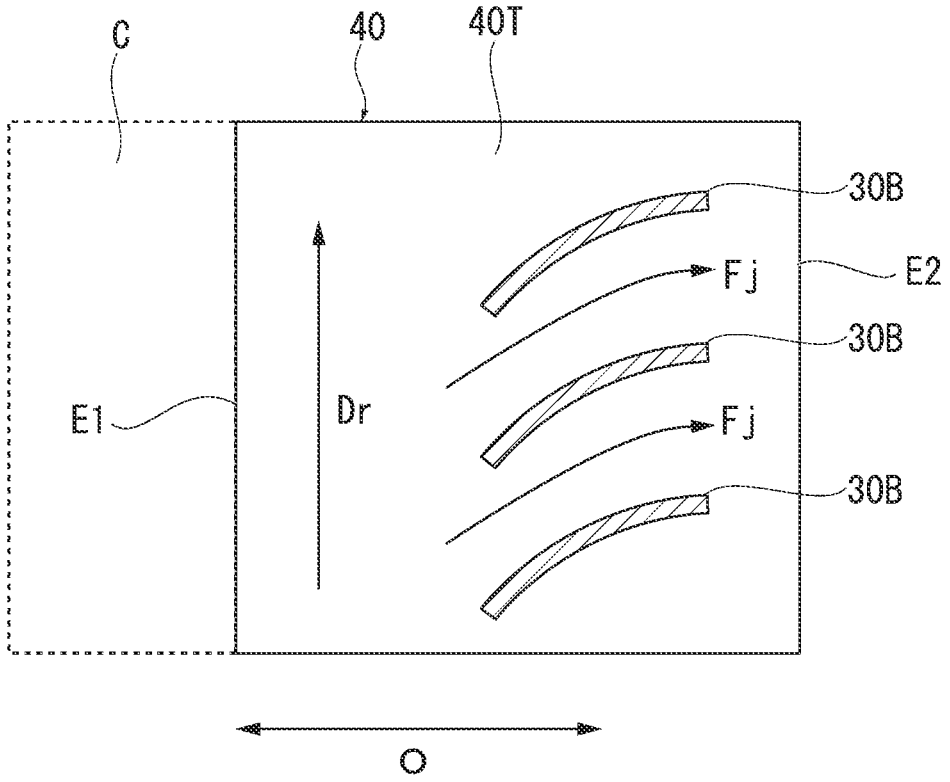
FIG. 4 is a view showing a modified example of a support portion according to the first embodiment of the present disclosure and is a view when the support portion is viewed from a radial direction.
Figure 5:
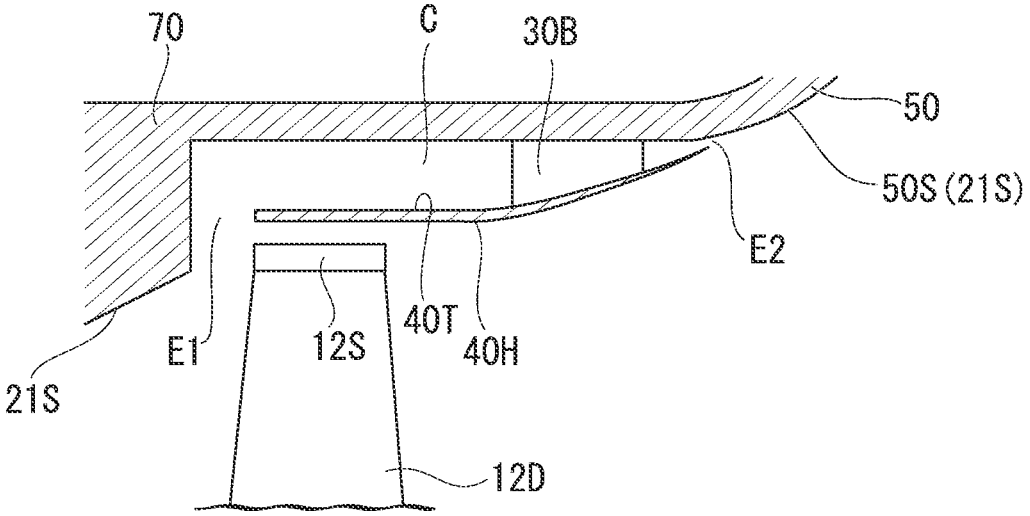
FIG. 5 is a main enlarged cross-sectional view showing a modified example of the support portion according to the first embodiment of the present disclosure.

Further, a configuration shown in FIG. 4 and FIG. 5 can be adopted as the modified example of the support portion 30. In the example of the drawing, each of support portions 30B is curved backward in the rotation direction Dr of the rotor 1 as it approaches the downstream side. That is, these support portions 30B is protruded toward the front side of the rotation direction Dr. Further, the support portion 30B is placed at a position biasedly close to the discharge port E2 in the cavity C.

Here, the flow flowing into the cavity C contains a swirling flow component that swirls in the rotation direction Dr as the rotor 1 rotates. In the above-described configuration, the swirling flow component is reduced by the support portion 30B and the component in the direction of the axis O contained in the flow increases on the downstream side of the support portion 30B. Accordingly, it is possible to further promote the Coanda effect due to the flow blown out from the discharge port E2. Thus, it is possible to allow the flow to further follow the inner peripheral surface 21S. As a result, it is possible to further reduce the possibility of the separation of the flow.

Further, according to the above-described configuration, since the support portion 30B is placed at a position biasedly close to the discharge port E2, it is possible to stably control the direction of the flow blown out from the discharge port E2. On the other hand, if the support portion 30B is placed at a position biasedly close to the extraction port E1, the flow is disturbed by the support portion 30B itself in the cavity C before reaching the discharge port E2. As a result, there is a possibility that the Coanda effect cannot be stably developed on the downstream side of the discharge port E2. According to the above-described configuration, it is possible to suppress such a possibility.

Second Embodiment

Figure 6:
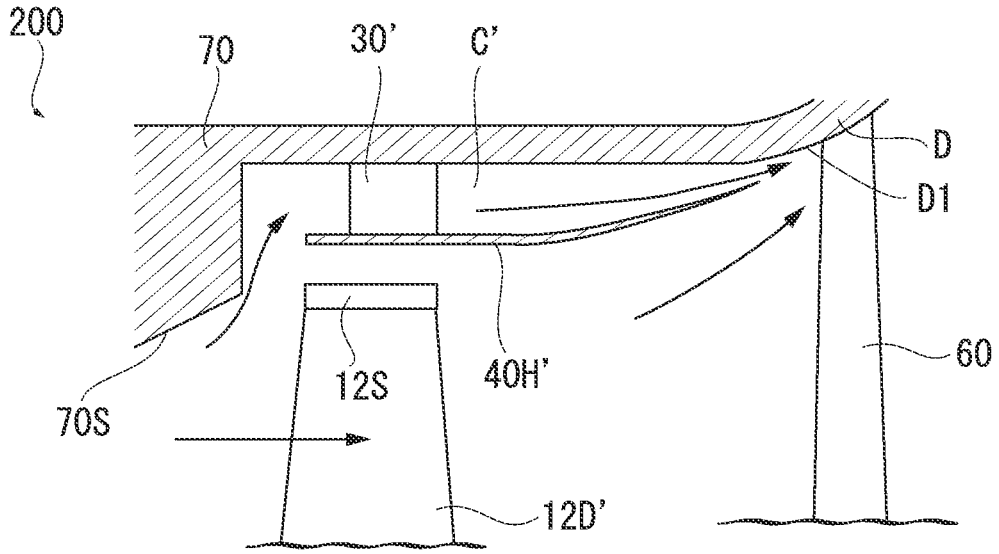
FIG. 6 is a main enlarged cross-sectional view of an axial flow turbine according to a second embodiment of the present disclosure.

Next, a second embodiment of the present disclosure will be described with reference to FIG. 6. Additionally, the same components as those in the first embodiment are denoted by the same reference numerals, and detailed description thereof will be omitted. As shown in the same drawing, in this embodiment, the cavity C and the inner peripheral member 40 are applied to an axial flow turbine 200 which exhausts in the direction of the axis O instead of the steam turbine 100 which changes the exhaust direction by the above-described exhaust chamber. The axial flow turbine 200 which exhausts in the direction of the axis O is not limited to the steam turbine and also includes a gas turbine. The axial flow turbine 200 includes a diffuser D which includes an inner radial side wall surface D1 on the downstream side of a final stage blade row 12D' instead of the above-described exhaust chamber. Even in this embodiment, a cavity C' is formed in a portion corresponding to the final stage blade row 12D' in an inner peripheral surface 70S (casing inner peripheral surface) of a turbine casing 70. Further, the cavity C' is lined by an inner peripheral member body 40H' from the radial inside. The inner peripheral member body 40H' is fixed to the inner peripheral surface of the cavity C' by a support portion 30'. Further, a strut 60 which supports the inner radial side wall surface D1 of the diffuser D is provided on the downstream side of the final stage blade row 12D'.

According to the above-described configuration, since it is possible to suppress the separation of the flow passing through the final stage blade row 12D' and flowing into the diffuser D, it is possible to increase the expansion ratio of the cross-sectional area in the diffuser D as compared with the conventional case. Thus, it is possible to shorten the dimension of the diffuser D in the direction of the axis O. That is, it is possible to shorten the total length of the axial flow turbine 200 and to miniaturize the turbine.

The second embodiment of the present disclosure has been described above. Further, various changes and modifications can be made to the above configuration without departing from the gist of the present disclosure.

Third Embodiment

Figure 7:
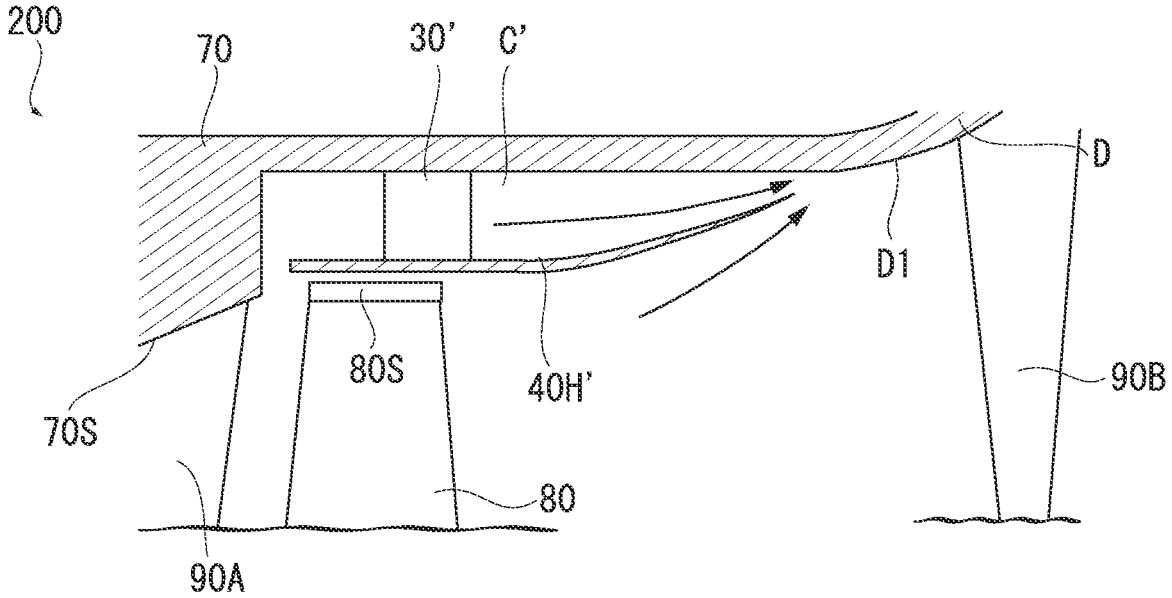
FIG. 7 is a main enlarged cross-sectional view of an axial flow turbine according to a third embodiment of the present disclosure.

Next, a third embodiment of the present disclosure will be described with reference to FIG. 7. Additionally, the same components as those in each embodiment are denoted by the same reference numerals, and a detailed description thereof will be omitted. In this embodiment, the cavity C' described in each embodiment above is formed in a region corresponding to an intermediate stage blade row 80 in the turbine casing 70 of the axial flow turbine 200. The cavity C' is lined by the inner peripheral member body 40H' from the radial inside. The inner peripheral member body 40H' is fixed to the inner peripheral surface of the cavity C' by the support portion 30'. Further, intermediate stage vane rows 90A and 90B are respectively provided on the upstream side and the downstream side of the intermediate stage blade row 80 through a vane holding ring (not shown). Further, a shroud 80S is provided at the tip of the intermediate stage blade row 80.

According to the above-described configuration, since the separation of the flow passing through the intermediate stage blade row 80 is reduced, it is possible to further improve the performance of the axial flow turbine 200 as the turbine. Further, since it is possible to suppress the occurrence of the separation on the downstream side of the intermediate stage blade row 80, it is possible to have a large expansion ratio of the diameter in the casing. Conversely, the blade height of the intermediate stage blade row 80 can be suppressed to be smaller than the blade height of the other blade row located on the downstream side of the intermediate stage blade row 80. That is, it is possible to shorten the axial length of the turbine and to miniaturize the axial flow turbine as compared with the conventional axial flow turbine having the final stage blade row of the same diameter.

The third embodiment of the present disclosure has been described above. Further, various changes and modifications can be made to the above configuration without departing from the gist of the present disclosure.

Fourth Embodiment

Figure 8:
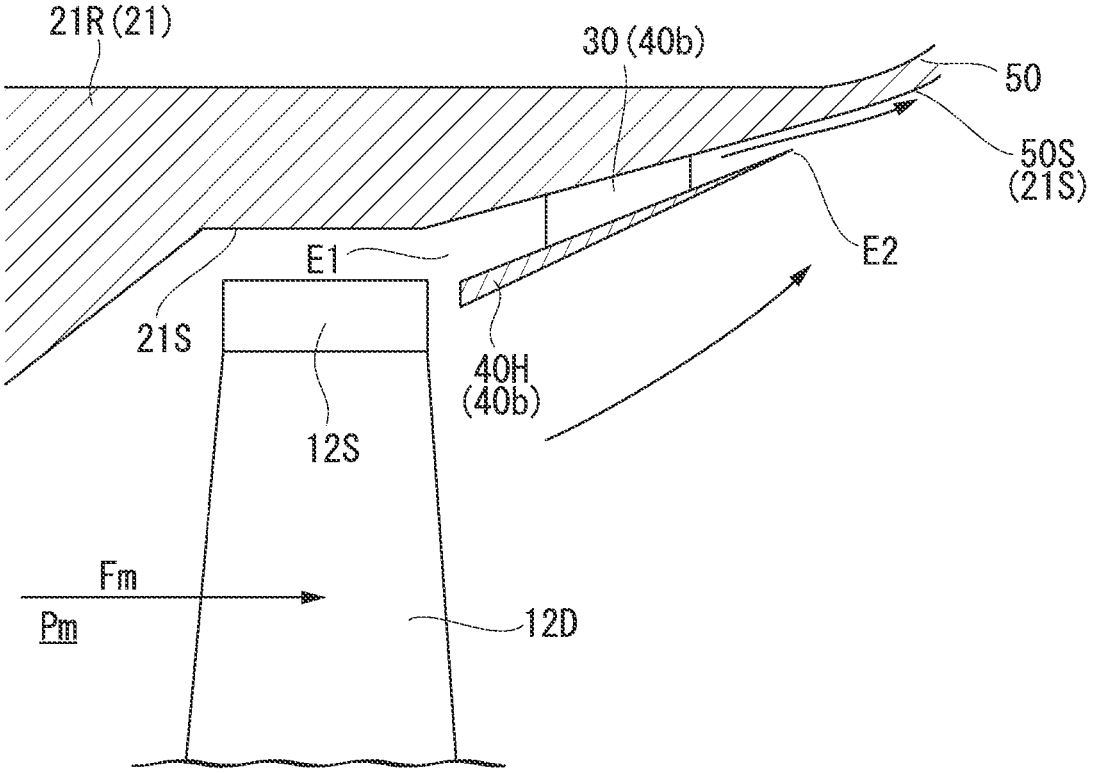
FIG. 8 is a main enlarged cross-sectional view of an axial flow turbine according to a fourth embodiment of the present disclosure.

Next, a fourth embodiment of the present disclosure will be described with reference to FIG. 8. Additionally, the same components as those in each embodiment are denoted by the same reference numerals, and a detailed description thereof will be omitted. In this embodiment, the above-described cavity C is not formed on the casing inner peripheral surface 21S in the steam turbine 100 described in the first embodiment. The casing inner peripheral surface 21S is gradually expanded in diameter as a whole from the upstream side toward the downstream side. Additionally, a portion corresponding to the final stage blade row 12D in the casing inner peripheral surface 21S is extended in parallel to the axis O.

In addition, it is also possible to adopt a configuration in which the portion is formed in a stepped shape in order to provide a fin seal.

Further, an inner peripheral member 40*b* is provided on the downstream side of the final stage blade row 12D of the casing inner peripheral surface 21S. The inner peripheral member 40*b* includes the inner peripheral member body 40H and the support portions 30 which supports the inner peripheral member body 40H on the casing inner peripheral surface 21S. The inner peripheral member body 40H is extended along the casing inner peripheral surface 21S. That is, the inner peripheral member body 40H is extended so as to be expanded radially outward as it approaches the downstream side of the inner peripheral member body 40H from the upstream side. The support portion 30 connects the casing inner peripheral surface 21S and the outer peripheral surface of the inner peripheral member body 40H. Additionally, the configuration described in the first embodiment or the second modified example of the first embodiment can be adopted as the support portion 30.

According to the above-described configuration, part of the fluid flowing through the casing 2 flows into a space between the inner peripheral member body 40H and the casing inner peripheral surface 21S through the extraction port E1. The fluid having flowed into the space is blown out from the discharge port E2 toward the downstream side. By this flow, the flow following the inner peripheral surface of the inner peripheral member body 40H is drawn by the Coanda effect with respect to the flow blown out from the discharge port E2. Thus, it is possible to reduce the possibility that a fluid may be separated from the casing inner peripheral surface 21S on the downstream side of the inner peripheral member body 40H. Further, in the above-described configuration, a fluid flowing through the casing 2 can be directly guided by the inner peripheral member body 40H while not being trapped in the cavity C or the like. Accordingly, it is possible to suppress the separation of the flow while suppressing the loss occurring when the fluid flows into the cavity C.

The fourth embodiment of the present disclosure has been described above. Further, various changes and modifications can be made to the above configuration without departing from the gist of the present disclosure.

Fifth Embodiment

Figure 9:
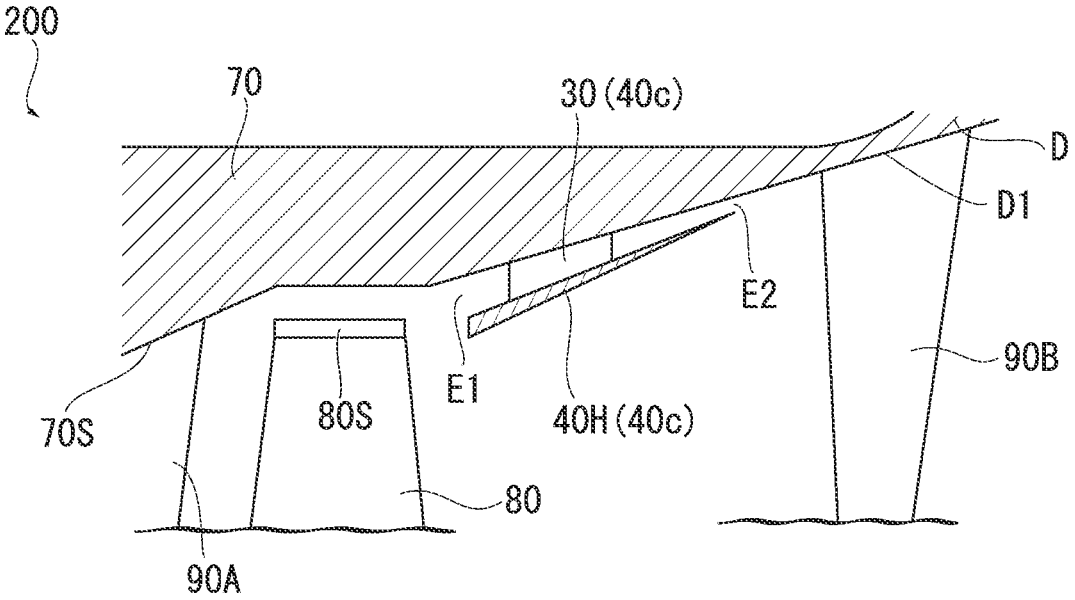
FIG. 9 is a main enlarged cross-sectional view of an axial flow turbine according to a fifth embodiment of the present disclosure.

Next, a fifth embodiment of the present disclosure will be described with reference to FIG. 9. Additionally, the same components as those in each embodiment are denoted by the same reference numerals, and detailed description thereof will be omitted. In this embodiment, an inner peripheral member 40*c* described in each embodiment above is provided in a region corresponding to the intermediate stage blade row 80 in the turbine casing 70 of the axial flow turbine 200. Further, in this embodiment, the above-described cavity C' is not formed on the inner peripheral surface (casing inner peripheral surface) of the turbine casing 70. That is, the inner peripheral surface 70S is gradually expanded in diameter as a whole from the upstream side toward the downstream side. Additionally, a portion corresponding to the intermediate stage blade row 80 in the inner peripheral surface 70S is extended in parallel to the axis O. In addition, it is also possible to adopt a configuration in which the portion is formed in a stepped shape in order to provide a fin seal. Further, the intermediate stage vane rows 90A and 90B are respectively provided on the upstream side and the downstream side of the intermediate stage blade row 80 through a vane holding ring (not shown).

The inner peripheral member 40*c* is provided on the downstream side of the intermediate stage blade row 80 in the inner peripheral surface 70S. The inner peripheral member 40*c* includes the inner peripheral member body 40H and the support portions 30. The inner peripheral member body 40H is extended along the inner peripheral surface 70S. That is, the inner peripheral member body 40H is extended so as to be expanded radially outward as it approaches the downstream side of the inner peripheral member body 40H from the upstream side. The support portion 30 connects the casing inner peripheral surface 21S and the outer peripheral surface of the inner peripheral member body 40H. Additionally, the configuration described in the first embodiment or the second modified example of the first embodiment can be adopted as the support portion 30.

According to the above-described configuration, since the separation of the flow passing through the intermediate stage blade row 80 is reduced, it is possible to further improve the performance of the axial flow turbine 200 as the turbine. Further, since it is possible to suppress the occurrence of the separation on the downstream side of the intermediate stage blade row 80, it is possible to have a large expansion ratio of the diameter in the casing. Conversely, the blade height of the intermediate stage blade row can be suppressed to be smaller than the blade height of the other blade row located on the downstream side of the intermediate stage blade row 80. That is, it is possible to shorten the axial length of the turbine and to miniaturize the axial flow turbine as compared with the conventional axial flow turbine having the final stage blade row of the same diameter.

Further, in the above-described configuration, a fluid flowing through the turbine casing 70 can be directly guided by the inner peripheral member body 40H while not being trapped in the cavity C or the like. Accordingly, it is possible to suppress the separation of the flow while suppressing the loss occurring when the fluid flows into the cavity C.

The fifth embodiment of the present disclosure has been described above. Further, various changes and modifications can be made to the above configuration without departing from the gist of the present disclosure.

(Appendix)

The turbine described in each embodiment is grasped as follows, for example.

(1) The turbine 100 according to a first aspect includes: the rotor 1 including the rotation shaft 11 which is allowed to rotate around the axis O and the blade row 12 formed on the outer peripheral surface of the rotation shaft 11; the casing 2 covering the outer circumference of the rotor 1 and which has the casing inner peripheral surface 21S expanding radially outward as it approaches the downstream side of the casing 2 in the direction of the axis O; and the inner peripheral member body 40H which is formed to line the casing inner peripheral surface 21S of the casing such that the extraction port E1 is formed between the upstream side end of the inner peripheral member body and the inner peripheral surface, and the discharge port E2 is formed between the downstream side end of the inner peripheral member body and the casing inner peripheral surface 21S, wherein the extraction port E1 and the discharge port E2 are formed in an annular shape centered on the axis O and the flow path cross-sectional area of the discharge port E2 is smaller than that of the extraction port E1.

According to the above-described configuration, part of the fluid flowing through the casing 2 flows into a space between the inner peripheral member body 40H and the casing inner peripheral surface 21S through the extraction port E1. The fluid having flowed into the space is blown out from the discharge port E2 toward the downstream side as the jet air flow. Due to this flow, the flow following the inner peripheral surface of the inner peripheral member body 40H is drawn to the flow blown out from the discharge port E2 due to the Coanda effect. Thus, it is possible to reduce the occurrence of the separation of the fluid from the casing inner peripheral surface 21S on the downstream side of the inner peripheral member body 40H. Further, in the above-described configuration, since the extraction port E1 and the discharge port E2 are formed in an annular shape centered on the axis O, it is possible to suppress the occurrence of the separation over the entire circumference in the casing 2. Further, according to the above-described configuration, the flow path cross-sectional area of the discharge port E2 is made smaller than the flow path cross-sectional area of the extraction port. Accordingly, the flow velocity of the fluid from the extraction port E1 toward the discharge port E2 increases. As a result, the flow velocity of the fluid blown out from the discharge port E2 can be made higher than the flow velocity of the fluid flowing to the inner peripheral side in relation to the inner peripheral member body 40H. Thus, it is possible to further reduce the possibility of the separation of the flow on the downstream side of the inner peripheral member body 40H.

(2) In the turbine 100 according to a second aspect, the casing inner peripheral surface 21S is provided with the cavity C which is formed in a portion corresponding to the blade row 12 in the casing inner peripheral surface 21S to be recessed radially outward and which has an annular shape centered on the axis O and the inner peripheral member body 40H is provided to line the inner peripheral side of the cavity C.

According to the above-described configuration, a part of the fluid flowing through the casing 2 flows into the cavity C through the extraction port E1. The fluid having flowed into the cavity C is blown out from the discharge port E2 toward the downstream side. Accordingly, the flow following the inner peripheral surface of the inner peripheral member body 40H is drawn to the flow blown out from the discharge port E2 due to the Coanda effect. Thus, it is possible to reduce the possibility that the fluid is separated from the casing inner peripheral surface 21S on the downstream side of the inner peripheral member body 40H. Further, in the above-described configuration, since the extraction port E1 and the discharge port E2 are formed in an annular shape centered on the axis O, it is possible to suppress the occurrence of the above-described separation over the entire circumference in the casing 2. Further, according to the above-described configuration, the flow path cross-sectional area of the discharge port E2 is made smaller than the flow path cross-sectional area of the extraction port. Accordingly, the flow velocity of the fluid flowing through the cavity C from the extraction port E1 toward the discharge port E2 increases. As a result, the flow velocity of the fluid blown out from the discharge port E2 can be made higher than the flow velocity of the fluid flowing outside the cavity C. Thus, it is possible to further reduce the possibility of the separation of the flow on the downstream side of the cavity C.

(3) In the turbine 100 according to a third aspect, the inner diameter of the casing inner peripheral surface 21S is gradually expanded from the upstream side of the turbine toward the downstream side and the inner peripheral member body 40H is extended along the casing inner peripheral surface 21S.

According to the above-described configuration, a part of the fluid flowing through the casing 2 becomes a leaking flow, passes between the tip of the blade row 12 and the casing inner peripheral surface 21S, and then flows into a space between the inner peripheral member body 40H and the casing inner peripheral surface 21S through the extraction port E1. The fluid having flowed into the space is blown out from the discharge port E2 toward the downstream side. Due to this flow, the flow following the inner peripheral surface of the inner peripheral member body 40H is drawn to the flow blown out from the discharge port E2 due to the Coanda effect. That is, this is effectively used in order to simply return the leakage flow to the main flow and develop the Coanda effect. Thus, it is possible to reduce the possibility that the fluid is separated from the casing inner peripheral surface 21S on the downstream side of the inner peripheral member body 40H.

(4) In the turbine 100 according to a fourth aspect, in the cross-sectional view of the turbine cut in the direction of the axis O, the tangent line Lc through the edge P2 of the discharge port E2 of the inner peripheral member body 40H is inclined so as to be far away from the axis O toward the downstream side.

According to the above-described configuration, since the tangent line Lc through the edge P2 of the discharge port E2 of the inner peripheral member body 40H is inclined so as to be far away from the axis O toward the downstream side, the flow blown out from the discharge port E2 can follow the casing inner peripheral surface 21S on the downstream side of the inner peripheral member body 40H. Accordingly, the development of the Coanda effect is promoted, and the flow can be further drawn toward the casing inner peripheral surface 21S. That is, it is possible to further reduce the occurrence of the separation of the flow.

(5) The turbine 100 according to a fifth aspect further includes the support portion 30 supporting the inner peripheral member body 40H by connecting the outer peripheral surface of the inner peripheral member body 40H to the casing inner peripheral surface 21S.

According to the above-described configuration, it is possible to stably support the inner peripheral member body 40H on the casing inner peripheral surface 21S by the support portion 30.

(6) In the turbine 100 according to a sixth aspect, the support portion 30B is curved backward in the rotation direction Dr of the rotation shaft 11 as it goes from the upstream side toward the downstream side.

According to the above-described configuration, the support portion 30B is curved backward in the rotation direction Dr toward the downstream side. Here, the flow flowing between the outer peripheral surface of the inner peripheral member body and the casing inner peripheral surface 21S contains a swirling flow component that swirls in the rotation direction Dr in accordance with the rotation of the rotation shaft 11. In the above-described configuration, the swirling flow component is reduced by the support portion 30B and the component of the direction of the axis O contained in the flow increases on the downstream side of the support portion 30B. Accordingly, it is possible to further promote the Coanda effect due to the flow blown out from the discharge port E2. Thus, it is possible to allow the flow to further follow the casing inner peripheral surface 21S. As a result, it is possible to further reduce the possibility of the separation of the flow.

(7) In the turbine 100 according to a seventh aspect, the support portion 30B is placed at the position biasedly close to the discharge port E2 of the inner peripheral member body 40H.

According to the above-described configuration, since the support portion 30B is placed at the position biasedly close to the discharge port E2, it is possible to stably control the direction of the flow blown out from the discharge port E2. On the other hand, if the support portion 30B is placed at a position biasedly close to the extraction port E1, the flow is disturbed before reaching the discharge port E2. As a result, there is a possibility that the Coanda effect cannot be stably developed on the downstream side of the discharge port E2. According to the above-described configuration, it is possible to suppress such a possibility.

(8) In the turbine 100 according to an eighth aspect, the blade row 12 is the final stage blade row 12D of the steam turbine 100 and the casing inner peripheral surface 21S includes the inner peripheral surface of the flow guide 50 provided on the downstream side of the final stage blade row 12D.

According to the above-described configuration, since the separation of the flow is reduced, it is possible to shorten the dimension of the flow guide 50 in the direction of the axis O. As a result, it is possible to reduce the occupied area of the entire device and reduce the manufacturing cost.

(9) In the turbine according to a ninth aspect, the edge P2 of the discharge port E2 of the inner peripheral member body 40H is, when viewed from the radial direction of the axis O, located on the downstream side of the beginning point Pc of the flow guide 50.

According to the above-described configuration, the edge P2 located on the side of the discharge port E2 of the inner peripheral member body is located on the downstream side of the beginning point Pc of the flow guide 50. Accordingly, it is possible to allow the flow blown out from the discharge port E2 to further follow the casing inner peripheral surface 21S. As a result, it is possible to further reduce the possibility of the separation of the flow.

(10) In the turbine 200 according to a tenth aspect, the blade row is the intermediate stage blade row 80 of the axial flow turbine 200.

According to the above-described configuration, since the separation of the flow passing through the intermediate stage blade row 80 is reduced, it is possible to further improve the performance of the axial flow turbine 200 as the turbine. Further, it is possible to suppress the blade height of the other blade row located on the upstream side of the intermediate stage blade row 80 to be low. As a result, it is possible to miniaturize the turbine 200.

(11) In the turbine 200 according to an eleventh aspect, the blade row is the final stage blade row 12D' of the axial flow turbine 200.

According to the above-described configuration, since the separation of the flow passing through the final stage blade row 12D' is reduced, it is possible to further improve the performance of the axial flow turbine 200 as the turbine. Further, it is possible to suppress the blade height of the other blade row located on the upstream side of the final stage blade row 12D' to be low. As a result, it is possible to miniaturize the turbine 200.

INDUSTRIAL APPLICABILITY

According to the present disclosure, it is possible to provide a turbine with further improved performance by reducing efficiency loss.

REFERENCE SIGNS LIST

100 Steam turbine (turbine)
200 Axial flow turbine (turbine)
1 Rotor
2 Casing
2E Supply pipe
11 Rotation shaft
12 Blade row
12D, 12D' Final stage blade row
21 Inner casing
21H Inner casing body
21R Vane holding ring
21S Inner peripheral surface (casing inner peripheral surface)
22 Exhaust casing
22A Bearing cone
22B Outer casing
30B, 30' Support portion
40', 40*b*, 40*c* Inner peripheral member
40H' Inner peripheral member body
40S Guide surface
40T Flow path forming surface
50 Flow guide
50S Inner peripheral surface of flow guide
60 Strut
70 Turbine casing
80 Intermediate stage blade row
90B Intermediate stage vane row
C, C' Cavity
C1 Cavity inner peripheral surface
C2 Cavity upstream surface
Dr Rotation direction
O Axis
P1, P2 Edge
Pc Beginning point of flow guide

The invention claimed is:

1. A turbine comprising:

a rotor including:

a rotation shaft that rotates around an axis of the rotation shaft; and blade rows on an outer peripheral surface of the rotation shaft that are separated from each other in a direction of the axis;

a casing covering an outer circumference of the rotor and that has a casing inner peripheral surface expanding radially outward toward downstream of the casing; and an inner peripheral member body that:

extends over the casing inner peripheral surface of the casing, and forms:

an extraction port between an upstream side end of the inner peripheral member body and the casing inner peripheral surface, and a discharge port between a downstream side end of the inner peripheral member body and the casing inner peripheral surface, wherein the inner peripheral member body is separated in a radial direction of the rotor from a final stage blade row that is disposed on a most downstream side of the blade rows and faces at least a portion of the final stage blade row in the radial direction, wherein the extraction port is disposed upstream of a downstream end of the final stage blade row, wherein the discharge port is disposed downstream of the final stage blade row, wherein the extraction port and the discharge port are in an annular shape centered on the axis, and wherein a flow path cross-sectional area of the discharge port is smaller than a flow path cross-sectional area of the extraction port.

2. The turbine according to claim 1, wherein the casing inner peripheral surface has a cavity in a portion of the casing inner peripheral surface corresponding to the final stage blade row that is recessed radially outward and that has an annular shape centered on the axis, and wherein the inner peripheral member body extends over an inner peripheral side of the cavity.

3. The turbine according to claim 1, wherein an inner diameter of the casing inner peripheral surface is gradually expanded from an upstream side of the turbine toward a downstream side of the turbine, and wherein the inner peripheral member body extends along the casing inner peripheral surface.

4. The turbine according to claim 1, wherein, in a cross-sectional view of the turbine including the axis, a tangent line through an edge of the discharge port of the inner peripheral member body is inclined to a radial outer side toward downstream.

5. The turbine according to claim 1, further comprising:

a support portion supporting the inner peripheral member body by connecting an outer peripheral surface of the inner peripheral member body to the casing inner peripheral surface.

6. The turbine according to claim 5, wherein the support portion is curved backward in a rotation direction of the rotation shaft from an upstream side of the turbine toward a downstream side of the turbine.

7. The turbine according to claim 5, wherein the support portion is disposed closer to the discharge port than to the extraction port.

8. The turbine according to claim 1, wherein the casing inner peripheral surface includes an inner peripheral surface of a flow guide downstream of the final stage blade row.

9. The turbine according to claim 8, wherein an edge of the discharge port of the inner peripheral member body is, when viewed from a radial direction with respect to the axis, disposed downstream of a beginning point of the flow guide.

* * * * *